US010622765B2

(12) United States Patent
Song et al.

(10) Patent No.: US 10,622,765 B2
(45) Date of Patent: Apr. 14, 2020

(54) BOARD MATING CONNECTOR

(71) Applicant: GigaLane Co., Ltd., Hwaseong-si, Gyeonggi-do (KR)

(72) Inventors: Hwa Yoon Song, Hwaseong-si (KR); Jin Uk Lee, Hwaseong-si (KR); Sun Hwa Cha, Hwaseong-si (KR); Chang Hyun Yang, Hwaseong-si (KR); Eun Jung Kim, Hwaseong-si (KR); Kyung Hun Jung, Hwaseong-si (KR); Hee seok Jung, Hwaseong-si (KR)

(73) Assignee: GigaLane Co., Ltd., Hwaseong-si, Gyeonggi-Do (KR)

( * ) Notice: Subject to any disclaimer, the term of this patent is extended or adjusted under 35 U.S.C. 154(b) by 0 days.

(21) Appl. No.: 16/361,419

(22) Filed: Mar. 22, 2019

(65) Prior Publication Data

US 2019/0305484 A1 Oct. 3, 2019

(30) Foreign Application Priority Data

Mar. 27, 2018 (KR) ..... 10-2018-0034833

(51) Int. Cl.
*H01R 13/64* (2006.01)
*H01R 13/6471* (2011.01)
(Continued)

(52) U.S. Cl.
CPC ..... *H01R 13/6471* (2013.01); *H01R 12/714* (2013.01); *H01R 12/91* (2013.01);
(Continued)

(58) Field of Classification Search
CPC .. H01R 13/6471; H01R 12/714; H01R 12/91; H01R 13/17
(Continued)

(56) References Cited

U.S. PATENT DOCUMENTS 4,372,636 A * 2/1983 Dufresne ..... H01R 11/285 439/178
4,815,986 A * 3/1989 Dholoo ..... H01R 13/631 439/248
(Continued)

FOREIGN PATENT DOCUMENTS

CN 201570651 U 9/2010
CN 104054221 A 9/2014
(Continued)

*Primary Examiner* — Alexander Gilman
(74) *Attorney, Agent, or Firm* — Brundidge & Stanger, P.C.

(57) ABSTRACT

In one example, the present invention relates to a signal contact unit with ameliorated passive inter-modulation distortion (PIMD) characteristics, and a board mating connector including the same. The signal contact unit includes a housing which has a housing insertion hole of which one side is open; a contact portion which has a contact portion insertion hole of which the other side is open; and a signal spring which is inserted between the one side of the housing insertion hole and the other side of the contact portion insertion hole, wherein one side of the housing is partially inserted into the contact portion insertion hole, and in a state in which the signal spring is compressed, an inner side of the contact portion comes into contact with an outer side of the housing so that the housing and the contact portion are electrically connected.

16 Claims, 14 Drawing Sheets

(51) Int. Cl.

| | |
|---|---|
| ***H01R 12/71*** | (2011.01) |
| ***H01R 13/17*** | (2006.01) |
| ***H01R 13/24*** | (2006.01) |
| ***H01R 24/50*** | (2011.01) |
| ***H01R 12/91*** | (2011.01) |
| *H01R 103/00* | (2006.01) |

(52) U.S. Cl.
CPC ..... *H01R 13/17* (2013.01); *H01R 13/2421* (2013.01); *H01R 24/50* (2013.01); *H01R 2103/00* (2013.01)

(58) Field of Classification Search
USPC ..... 439/66
See application file for complete search history.

(56) References Cited

U.S. PATENT DOCUMENTS 5,057,982 A * 10/1991 Hanami ..... H01R 33/09 362/368
5,380,211 A * 1/1995 Kawaguchi ..... H01R 4/30 439/74
5,516,310 A * 5/1996 Sawada ..... H01R 13/187 439/843
5,746,619 A * 5/1998 Harting ..... H01R 24/40 439/352
5,769,652 A * 6/1998 Wider ..... H01R 13/6315 439/248
5,936,421 A * 8/1999 Stowers ..... G01R 15/12 324/750.27
5,980,290 A * 11/1999 Meynier ..... H01R 13/6315 439/246
6,497,579 B1 * 12/2002 Garbini ..... H01R 13/6315 439/246
7,154,286 B1 * 12/2006 Marx ..... H01R 13/2421 324/755.05
7,416,418 B2 * 8/2008 Berthet ..... H01R 24/50 439/63
7,635,269 B2 * 12/2009 Oda ..... H01R 13/2421 439/71
8,167,633 B1 * 5/2012 Wu ..... H01R 35/025 439/164
8,690,583 B2 * 4/2014 Uesaka ..... H01R 12/714 439/63
8,747,152 B2 * 6/2014 Van Swearingen .... H01R 24/40 439/578
8,753,130 B2 * 6/2014 Sato ..... H01R 13/2428 439/66
9,065,186 B2 * 6/2015 Perrin ..... H01R 9/0515
9,310,395 B2 * 4/2016 Lee ..... G01R 1/06722
9,640,883 B2 * 5/2017 Tatzel ..... H01R 12/7082
9,735,531 B2 * 8/2017 Zhu ..... H01R 24/542
9,887,478 B2 * 2/2018 Schrameyer ..... H05B 3/06
2002/0061670 A1 * 5/2002 Havener ..... H01R 13/6315 439/246
2003/0060069 A1 * 3/2003 Duquerroy ..... H01R 24/50 439/188
2005/0280433 A1 * 12/2005 Nelson ..... G01R 1/06722 324/755.05
2008/0057782 A1 3/2008 Berthet et al.
2010/0159718 A1 * 6/2010 Duquerroy ..... H01R 13/2414 439/66
2010/0178798 A1 * 7/2010 Rosenberger ..... H01R 13/6315 439/578
2010/0297867 A1 * 11/2010 Rosenberger ..... H01R 24/542 439/345
2011/0318959 A1 * 12/2011 Uesaka ..... H01R 13/2421 439/581
2014/0030915 A1 * 1/2014 Perrin ..... H01R 24/50 439/578
2017/0141511 A1 * 5/2017 Tucker ..... H01R 13/5227
2017/0279205 A1 * 9/2017 Goirand ..... H01R 4/4809

FOREIGN PATENT DOCUMENTS

| | | | |
|---|---|---|---|
| CN | 104466484 | A | 3/2015 |
| CN | 104769783 | A | 7/2015 |
| EP | 1289076 | A2 | 3/2003 |
| EP | 1895625 | A1 | 3/2008 |
| JP | 07336115 | A | 12/1995 |
| JP | 08236227 | A | 9/1996 |
| JP | 2001307811 | A | 11/2001 |
| JP | 3107906 | U | 1/2005 |
| JP | 2013164973 | A | 8/2013 |
| JP | 2017126564 | A | 7/2017 |
| KR | 1020070012485 | A | 1/2007 |
| KR | 1020080004499 | A | 1/2008 |

* cited by examiner

200(210,220)
201(211,221)
300(310,320)

BOARD MATING CONNECTOR

CROSS-REFERENCE TO RELATED APPLICATION

This application claims the benefit under 35 U.S.C. § 119 of a Korean patent application No. 10-2018-0034833 filed on Mar. 27, 2018 in the Korean Intellectual Property Office, the entire disclosure of which is hereby incorporated herein by reference.

TECHNICAL FIELD

The embodiments described herein pertain generally to a signal contact unit with ameliorated passive inter-modulation distortion (PIMD) characteristics and a board mating connector including the same.

BACKGROUND

As shown in FIG. 1, a board mating connector, which has one side in contact with a board such as a printed circuit board on which a signal wiring is formed and transmits a radio frequency (RF) signal to the board, includes a signal contact unit 100 in contact with a signal electrode of the board and a ground contact unit 200 in contact with a ground electrode of the board.

The signal contact unit 100 includes a housing 110, a contact portion 120, and a signal spring 130.

Here, the housing 110 and the contact portion 120 are electrically connected through the signal spring 130.

However, when the RF signal is transmitted through the signal spring 130, passive inter-modulation distortion (PIMD) characteristics are degraded.

PRIOR ART DOCUMENTS

Patent Documents (Patent Document 1) KR 10-2015-0080486 A
(Patent Document 2) KR 10-152937 B1
(Patent Document 3) KR 0-1408249 B1

SUMMARY

The present invention is directed to providing a signal contact unit with ameliorated passive inter-modulation distortion (PIMD) characteristics and a board mating connector including the same.

In one example embodiment, a signal contact unit with ameliorated PIMD characteristics includes a housing which has a housing insertion hole of which one side is open; a contact portion which has a contact portion insertion hole of which the other side is open; and a signal spring which is inserted between the one side of the housing insertion hole and the other side of the contact portion insertion hole, wherein one side of the housing is partially inserted into the contact portion insertion hole, and in a state in which the signal spring is compressed, an inner side of the contact portion comes into contact with an outer side of the housing so that the housing and the contact portion are electrically connected.

The contact portion may include a contact portion protrusion which protrudes from an inner wall of the other end of the contact portion and include two or more contact portion slits which are elongated to one side of the contact portion from the other end thereof along a circumference of the contact portion.

In a state in which the signal spring is restored, the contact portion protrusion may be inserted into a housing groove formed in a ring shape along a circumference of the housing.

In one example embodiment, a signal contact unit includes a housing which has a housing insertion hole of which one side is open; a contact portion of which the other side is partially inserted into the housing insertion hole; and a signal spring which is inserted between the one side of the housing insertion hole and the other side of the contact portion, wherein, in a state in which the signal spring is compressed, an outer side of the contact portion comes into contact with an inner side of the housing so that the housing and the contact portion are electrically connected.

The housing may include a housing protrusion which protrudes from an inner wall of one end of the housing and include two or more housing slits which are elongated from one end of the housing to the other side thereof along a circumference of the housing.

In a state in which the signal spring is restored, the housing protrusion may be inserted into a contact portion groove formed in a ring shape along a circumference of the contact portion.

In one example, a board mating connector, which includes a signal contact unit with ameliorated PIMD characteristics, includes the signal contact unit having the ameliorated PIMD characteristics, wherein the board mating connector further includes a ground contact unit which has a ground hollow portion, wherein the signal contact unit is inserted into the ground hollow portion, and includes a dielectric unit which is disposed between the signal contact unit and the ground contact unit.

The ground contact unit may include a first ground portion which has a first ground hollow portion and include a second ground portion of which the other side is partially inserted into the first ground hollow portion and which has a second ground hollow portion.

The board mating connector may further include a ground spring which is disposed between an inner side of the first ground portion and an outer side of the second ground portion, wherein, when the second ground portion is moved in a direction of the first ground portion, the ground spring is compressed by the second ground portion, and the compressed ground spring is restored so that the second ground portion is moved in a direction opposite to the direction of the first ground portion.

The first ground portion may include a tapered portion which is formed on an inner wall of the first ground portion so as to have an inclined shape such that an inner diameter thereof is gradually decreased toward the other side thereof, and the second ground portion may include a second ground protrusion which protrudes outward from the other end of the second ground portion and two or more second ground slits which are elongated to one side of the second ground portion from the other end thereof along a circumference of the second ground portion, wherein, when the second ground portion is moved in the direction of the first ground portion, an outer diameter of the second ground protrusion is compressed by the tapered portion, and the compressed outer diameter of the second ground protrusion is restored in a direction in which an inner diameter of the tapered portion is increased so that the second ground portion is moved in the direction opposite to the direction of the first ground portion.

The first ground portion may include a tapered portion of which an inner diameter is gradually decreased toward the other side thereof on an inner wall of the first ground portion, and the second ground portion includes a second ground protrusion which protrudes outward from the other end of the second ground portion and two or more second ground slits which are elongated to one side of the second ground portion from the other end thereof along a circumference of the second ground portion, wherein, when the second ground portion is moved in a direction of the first ground portion, an outer diameter of the second ground protrusion is compressed by the tapered portion, and the compressed outer diameter of the second ground protrusion is restored in a direction in which an inner diameter of the tapered portion is increased so that the second ground portion is moved in a direction opposite to the direction of the first ground portion.

The dielectric unit may include a first dielectric portion which is disposed between the first ground portion and the signal contact unit and include a second dielectric portion which is disposed between the second ground portion and the signal contact unit, wherein a second dielectric hollow portion having a diameter greater than that of the signal contact unit is formed in the second dielectric portion so that the second dielectric portion is in surface contact with the second ground portion and is not in surface contact with the signal contact unit.

The first ground portion may include a thread formed on a circumference of the other side of the first ground portion; and a tightening portion formed to have three or more surfaces on a circumference of one side of the first ground portion.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

DETAILED DESCRIPTION

When a housing 110 and a contact portion 120 are electrically connected through a signal spring 130, there is a problem in that passive inter-modulation distortion (PIMD) characteristics are degraded.

Figure 1:
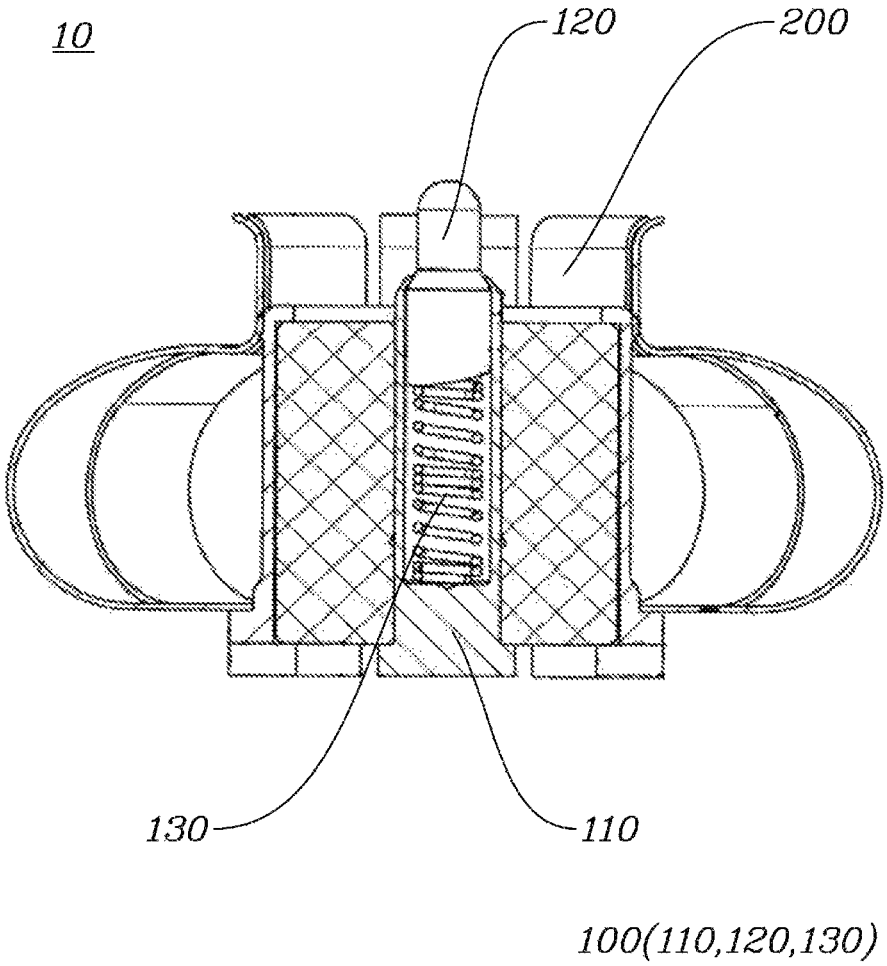
FIG. 1 is a cross-sectional view illustrating the related art.
Figure 2:
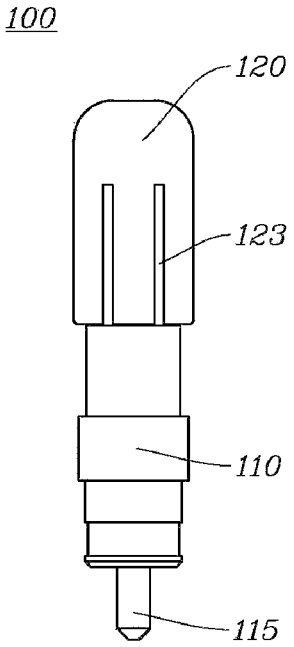
FIG. 2 is a view illustrating an exterior of a signal contact unit according to a first embodiment.
Figure 3:
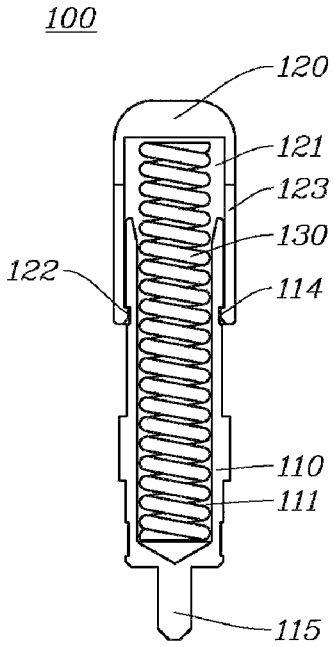
FIG. 3 is a cross-sectional view illustrating a restoration state of the signal contact unit according to the first embodiment.
Figure 4:
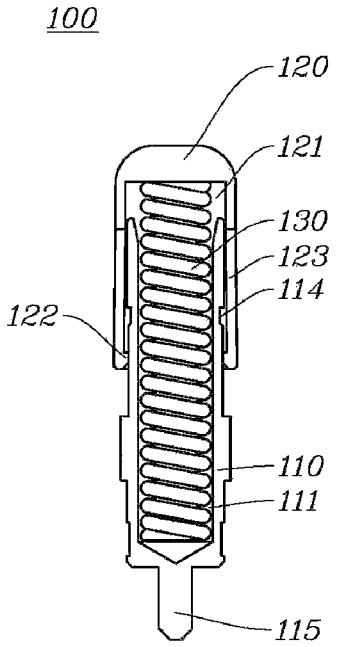
FIG. 4 is a cross-sectional view illustrating a compression state of the signal contact unit according to the first embodiment.

In order to solve the problem, as shown in FIGS. 2 to 4, a signal contact unit 100 according to a first embodiment of the present invention includes a housing 110, a contact portion 120, and a signal spring 130.

The housing 110 has a housing insertion hole 111 of which one side is open and includes a contact pin 115 formed at the other end thereof.

The contact portion 120 has a contact portion insertion hole 121 of which the other side is open.

The signal spring 130 is inserted between one side of the housing insertion hole 111 and the other side of the contact portion insertion hole 121.

One side of the housing 110 is partially inserted into the contact portion insertion hole 121.

As shown in FIG. 4, in a state in which one side of the contact portion 120 comes into contact with a board and the signal spring 130 is compressed, an inner side of the contact portion 120 comes into contact with an outer side of the housing 110, and thus, the housing 110 and the contact portion 120 are electrically connected.

The contact portion 120 includes a contact portion protrusion 122 and a contact portion slit 123 such that the inner side of the contact portion 120 stably comes into contact with the outer side of the housing 110.

The contact portion protrusion 122 is formed to protrude from an inner wall of the other end of the contact portion 120.

The contact portion slit 123 is elongated to one side of the contact portion 120 from the other end thereof. Two or more contact portion slits 123 are formed along a circumference of the contact portion 120 such that the other end of the contact portion 120 is divided into a plurality of portions.

As shown in FIG. 4, in a state in which one side of the contact portion 120 comes into contact with the board and the signal spring 130 is compressed, an inner diameter of the other end of the contact portion 120 is increased by the contact portion slit 123, and thus, the contact portion protrusion 122 stably comes into contact with the outer side of the housing 110 due to a restoring force of the other end of the contact portion 120 having the increased inner diameter.

In this case, in order to improve the stable contact, in a state in which the signal spring 130 is compressed, the inner diameter of the contact portion protrusion 122 may be smaller than an outer diameter of the housing 110 with which the contact portion protrusion 122 comes into contact.

In addition, in order to prevent the restoring force from being damaged due to a state, in which the inner diameter of the other end of the contact portion 120 is increased, being maintained, as shown in FIG. 3, in a state in which the signal spring 130 is restored, the contact portion protrusion 122 may be inserted into a housing groove 114 formed in a ring shape along a circumference of the housing 110.

Although not shown, in order for the signal spring 130 to not be electrically connected to the contact portion 120, a ball-shaped dielectric (not shown) may be disposed between the contact portion 120 and the signal spring 130, and the housing 110 and the contact portion 120 may be electrically connected only by a contact between the outer side of the housing 110 and the inner side of the contact portion 120.

Furthermore, one end of the contact portion 120 may be formed to have a groove or protrusion so as to increase a contact force with the board.

As described above, since the housing 110 and the contact portion 120 are electrically connected, the signal contact unit 100 according to the present invention has an effect of ameliorating PIMD characteristics.

Figure 5:
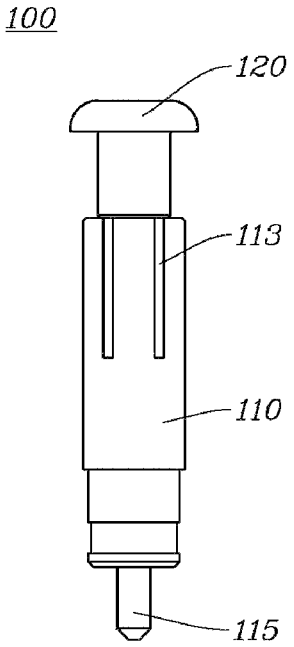
FIG. 5 is a view illustrating an exterior of a signal contact unit according to a second embodiment.
Figure 6:
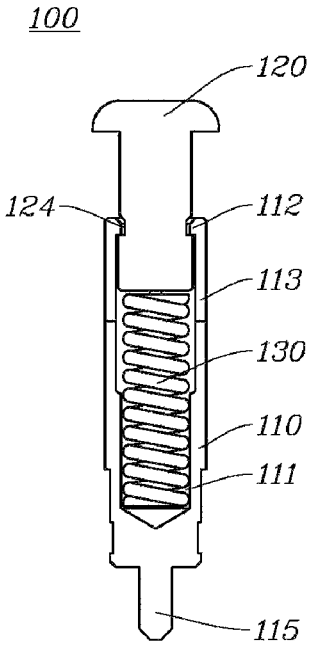
FIG. 6 is a cross-sectional view illustrating a restoration state of the signal contact unit according to the second embodiment.
Figure 7:
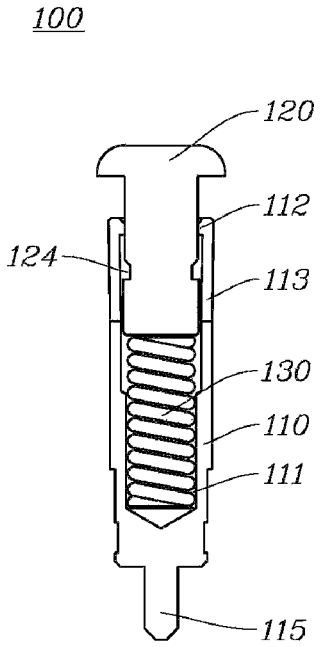
FIG. 7 is a cross-sectional view illustrating a compression state of the signal contact unit according to the second embodiment.

As shown in FIGS. 5 to 7, a signal contact unit 100 according to a second embodiment of the present invention includes a housing 110, a contact portion 120, and a signal spring 130.

The housing 110 has a housing insertion hole 111 of which one side is open and includes a contact pin 115 formed at the other end thereof.

The other side of the contact portion 120 is partially inserted into the housing insertion hole 111.

The signal spring 130 is inserted between one side of the housing insertion hole 111 and the other side of the contact portion 120.

As shown in FIG. 7, in a state in which one side of the contact portion 120 comes into contact with a board and the signal spring 130 is compressed, an outer side of the contact portion 120 comes into contact with an inner side of the housing 110, and thus, the housing 110 and the contact portion 120 are electrically connected.

The housing 110 includes a housing protrusion 112 and a housing slit 113 such that the outer side of the contact portion 120 stably comes into contact with the inner side of the housing 110.

The housing protrusion 112 protrudes from an inner wall of one end of the housing 110.

The housing slit 113 is elongated to the other side of one end of the housing 110. Two or more housing slits 113 are formed along a circumference of the housing 110 such that one end of the housing 110 is divided into a plurality of portions.

In this case, in order to improve the stable contact, in a state in which the signal spring 130 is compressed, an inner diameter of the housing protrusion 112 may be smaller than an outer diameter of the contact portion 120 with which the housing protrusion 112 comes into contact.

In addition, in order to prevent a restoring force from being damaged due to a state, in which an inner diameter of the one end of the housing 110 is increased, being maintained, as shown in FIG. 6, in a state in which the signal spring 130 is restored, the housing protrusion 112 may be inserted into a contact portion groove 124 formed in a ring shape along a circumference of the contact portion 120.

Although not shown, in order for the signal spring 130 to not be electrically connected to the contact portion 120, a ball-shaped dielectric may be disposed between the contact portion 120 and the signal spring 130, and the housing 110 and the contact portion 120 may be electrically connected only by a contact between the outer side of the housing 110 and the inner side of the contact portion 120.

In addition, one end of the contact portion 120 may be formed to have a groove or protrusion so as to increase a contact force with the board.

As described above, since the housing 110 and the contact portion 120 are electrically connected, the signal contact unit 100 according to the present invention has an effect of ameliorating PIMD characteristics.

Figure 8:
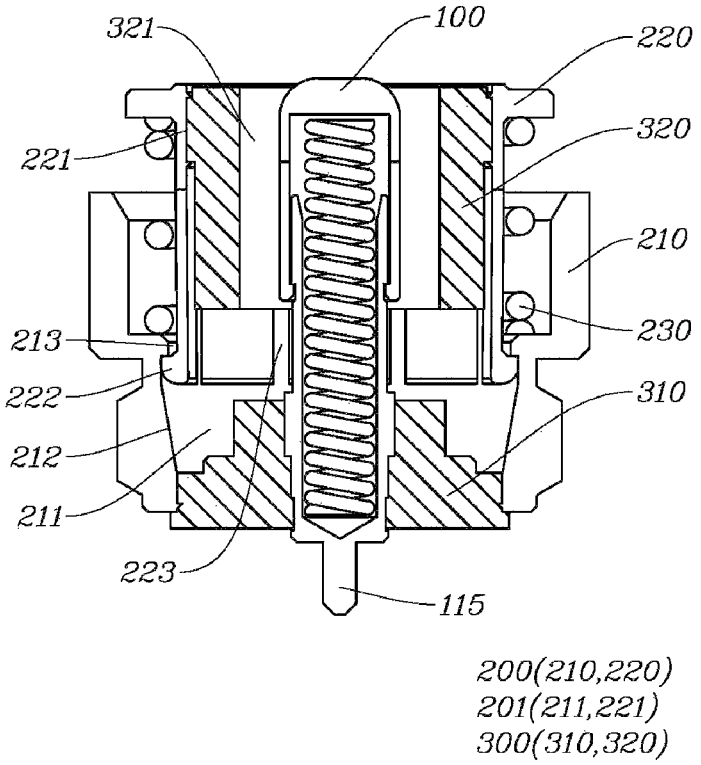
FIG. 8 is a cross-sectional view illustrating a restoration state of a board mating connector.
Figure 9:
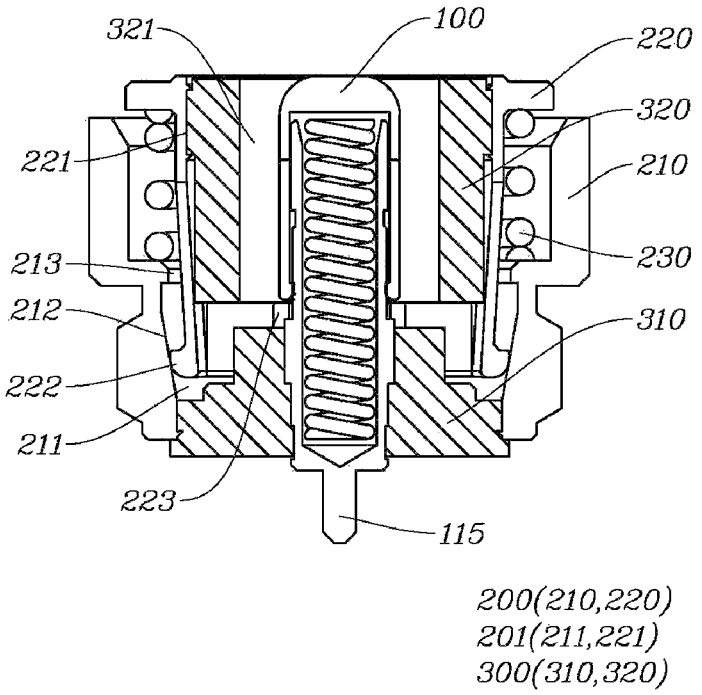
FIG. 9 is a cross-sectional view illustrating a compression state of the board mating connector.

As shown in FIGS. 8 and 9, a board mating connector including the signal contact units 100 according to each of the above-described first embodiment and second embodiment of the present invention may further include a ground contact unit 200, and a dielectric unit 300.

A ground hollow portion 201 is formed in the ground contact unit 200, and the signal contact unit 100 is inserted into the ground hollow portion 201.

The dielectric unit 300 is disposed between the signal contact unit 100 and the ground contact unit 200.

The ground contact unit 200 includes a first ground portion 210, a second ground portion 220, and a ground spring 230.

A first ground hollow portion 211 is formed in the first ground portion 210.

The other side of the second ground portion 220 is partially inserted into the first ground hollow portion 211, and a second ground hollow portion 221 is formed in the second ground portion 220.

The ground spring 230 is disposed between an inner side of the first ground portion 210 and an outer side of the second ground portion 220.

As shown in FIG. 9, when one side of the ground contact unit 200 comes into contact with a board and the second ground portion 220 is moved in a direction of the first ground portion 210, the ground spring 230 is compressed by the second ground portion 220, and the compressed ground spring 230 is restored. Thus, the second ground portion 220 is moved in a direction opposite to the direction of the first ground portion 210.

Figure 10:
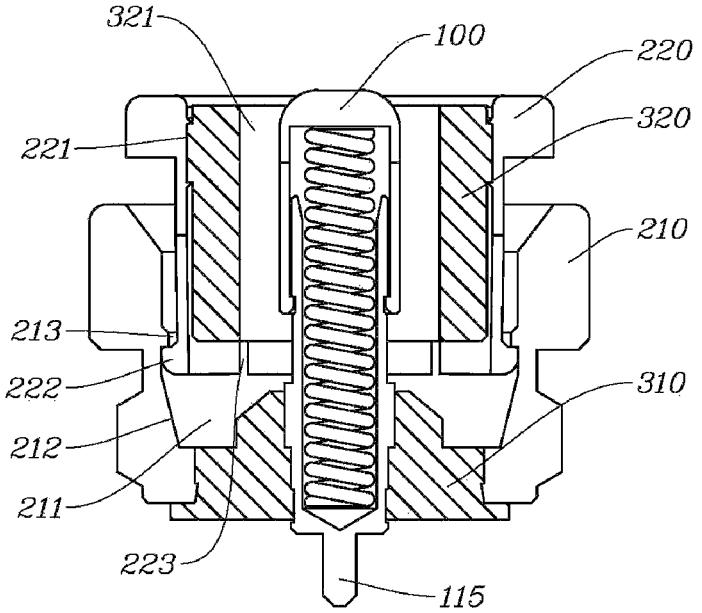
FIG. 10 is a cross-sectional view illustrating an embodiment not including a ground spring of a board mating connector.

As shown in FIGS. 8 and 9, a restoring force to move the second ground portion 220 in the direction opposite to the direction of the first ground portion 210 may be further increased. Alternatively, as shown in FIG. 10, in order to replace the ground spring 230 described above, the first ground portion 210 may include a tapered portion 212, and the second ground portion 220 may include a second ground protrusion 222 and a second ground slit 223.

The tapered portion 212 is formed in an inclined shape such that an inner diameter thereof is gradually decreased toward the other side thereof on an inner wall of the first ground portion 210.

The second ground protrusion 222 protrudes outward from the other end of the second ground portion 220.

The second ground slit 223 is elongated to one side of the second ground portion 220 from the other end thereof. Two or more second ground slits 223 are formed along a circumference of the second ground portion 220 such that the other end of the second ground portion 220 is divided into a plurality of portions.

When the second ground portion 220 is moved in the direction of the first ground portion 210, an outer diameter of the second ground protrusion 222 is compressed by the tapered portion 212, and the compressed outer diameter of the second ground protrusion 222 is restored in a direction in which an inner diameter of the tapered portion 212 is increased. Accordingly, the second ground portion 220 is moved in the direction opposite to the direction of the first ground portion 210.

In this case, in order to prevent the second ground portion 220 from being moved more than necessary in the direction opposite to the direction of the first ground portion 210, a latch portion 213 may be formed to protrude inward from a wall of the first ground portion 210 at one side of the wall of the first ground portion 210 with respect to a position where the tapered portion 212 is formed.

One side of the second ground protrusion 222 may be caught by the latch portion 213, and thus, the latch portion 213 may prevent the second ground portion 220 from being moved further in the direction opposite to the direction of the first ground portion 210.

As described above, as shown in FIGS. 8 and 9, when the above-described ground spring 230 is further provided, a restoring force due to the ground spring 230 may be added to a restoring force by which the second ground portion 220 is moved in the direction opposite to the direction of the first ground portion 210 by the tapered portion 212, the second ground protrusion 222, and the second ground slit 223.

Accordingly, it is possible to further increase the restoring force to move the second ground portion 220 in the direction opposite to the direction of the first ground portion 210.

In addition, as shown in FIG. 10, when the above-described ground spring 230 is not provided, the tapered portion 212, the second ground protrusion 222, and the second ground slit 223 may replace the ground spring 230.

The dielectric unit 300 includes a first dielectric portion 310 and a second dielectric portion 320.

The first dielectric portion 310 is disposed between the first ground portion 210 and the signal contact unit 100.

The second dielectric portion 320 is disposed between the second ground portion 220 and the signal contact unit 100.

As shown in FIG. 9, when the second ground portion 220 is moved in the direction of the first ground portion 210 and the second dielectric portion 320 approaches the first dielectric portion 310, in order to minimize a change in impedance, which is caused by a dielectric constant of the second dielectric portion 320 being added to a dielectric constant of the first dielectric portion 310, a second dielectric hollow portion 321 having a diameter greater than that of the signal contact unit 100 may be formed in the second dielectric portion 320. Accordingly, the second dielectric portion 320 may be in surface contact with the second ground portion 220 and may not be in surface contact with the signal contact unit 100.

Therefore, it is possible to minimize the change in impedance.

Figure 11:
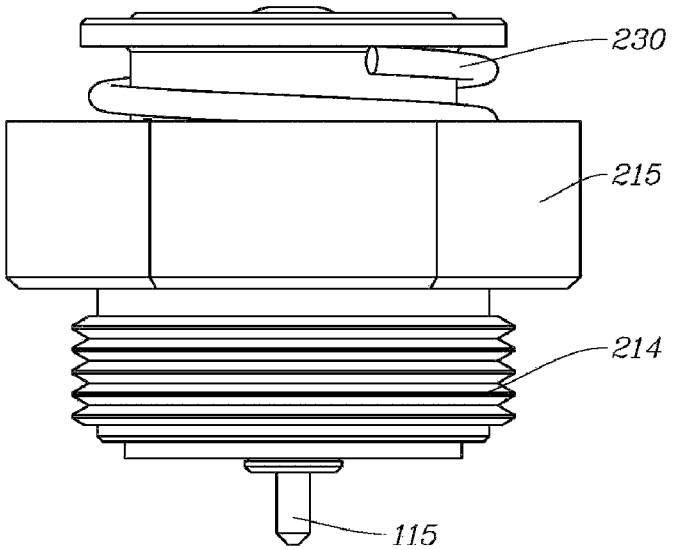
FIG. 11 is a front view illustrating a board mating connector.
Figure 12:
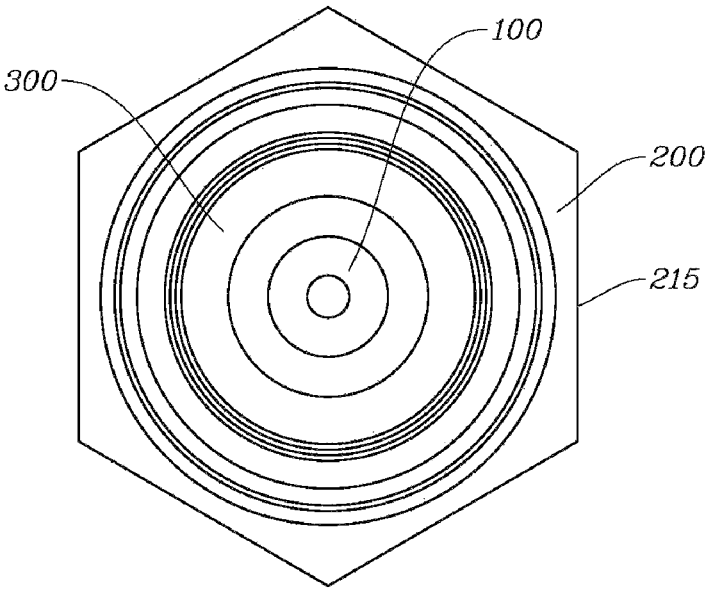
FIG. 12 is a plan view illustrating a board mating connector.
Figure 13:
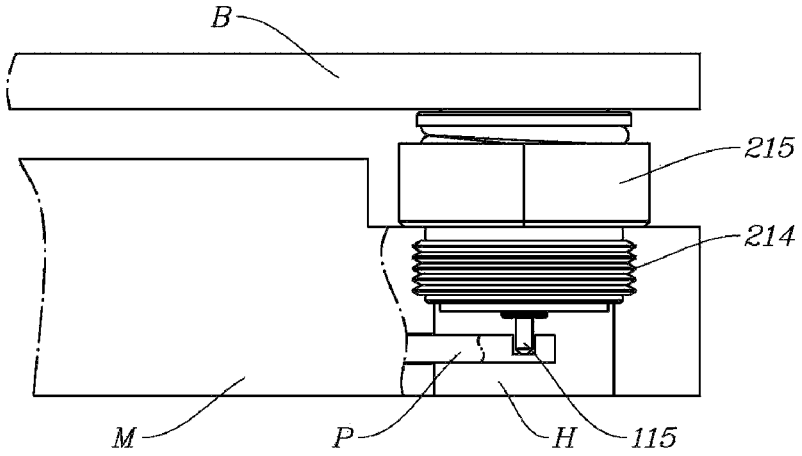
FIG. 13 is a view illustrating a state in which a board mating connector is inserted into a module.

As shown in FIGS. 11 to 13, the first ground portion 210 may include a thread 214 and a tightening portion 215 such that one side of the board mating connector according to the present invention is insertion-coupled to a module using a tool such as a wrench.

The thread 214 is formed on a circumference of the other side of the first ground portion 210.

The tightening portion 215 is formed to have three or more surfaces on a circumference of one side of the first ground portion 210.

As shown in FIG. 13, a module M has a hole H which has a wall corresponding to the thread 214, and the board mating connector is insertion-coupled to the hole H.

Here, the contact pin 115 may be electrically connected to a module signal pin P protruding toward a center of the hole H.

A board B comes into contact with one side of the board mating connector, and thus, the board mating connector transmits a radio frequency (RF) signal to the board B.

As described above, since the thread 214 and the tightening portion 215 are provided such that one side of the board mating connector is insertion-coupled to the module, a contact height of the board B may be lowered. Thus, it is possible to lower a height of the module M including the board mating connector, easily couple the board mating connector, and stably fix the board mating connector.

Figure 14:
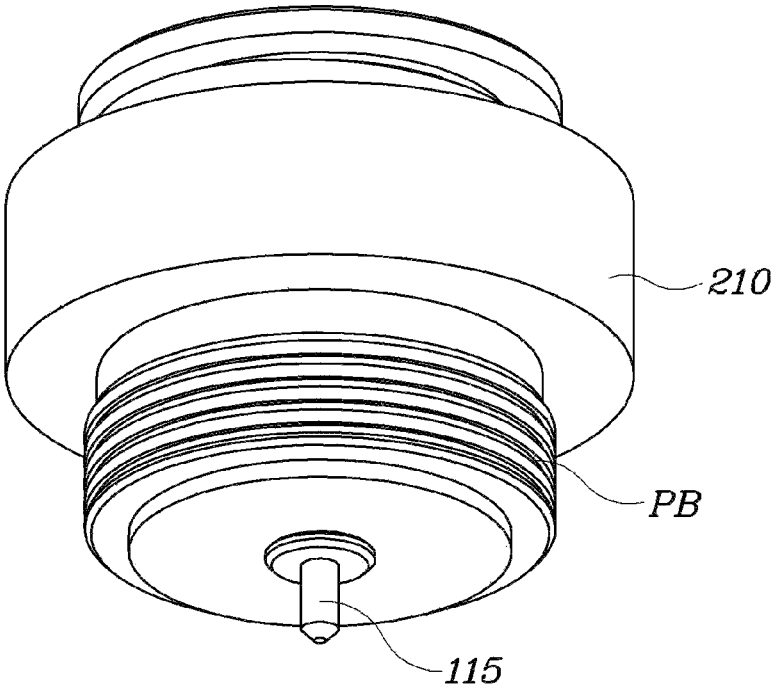
FIGS. 14 to 16 are views illustrating exteriors of board mating connectors.
Figure 16:
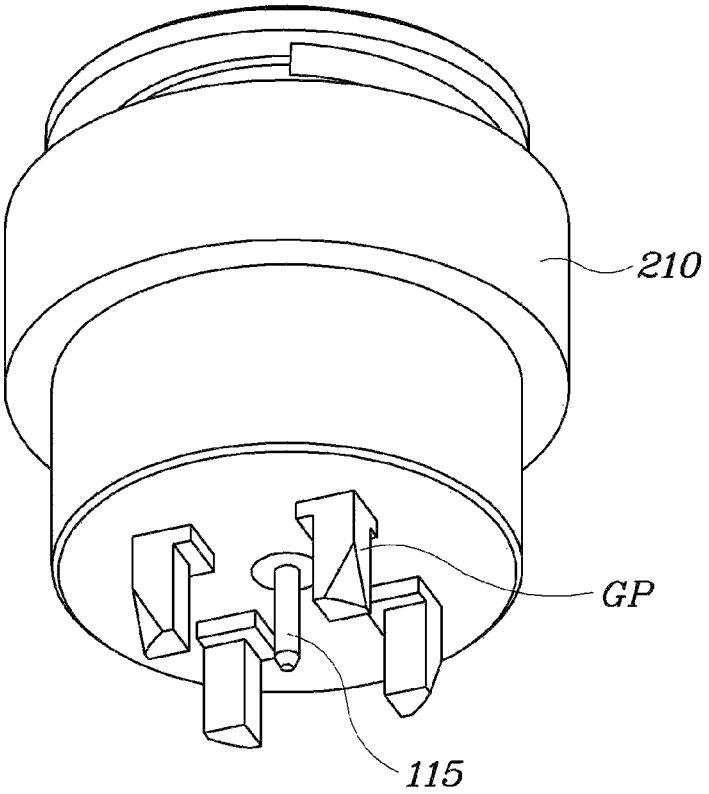

The exterior of the board mating connector according to the present invention is not limited to the above-described shape including the thread 214 and the tightening portion 215 and may be formed in various shapes as shown in FIGS. 14 and 16.

As shown in FIG. 14, the first ground portion 210 is formed in a cylindrical shape in which a plurality of press-fit protrusions PB are formed at one side of the first ground portion 210 such that the first ground portion 210 is press-fitted into the module.

Figure 15:
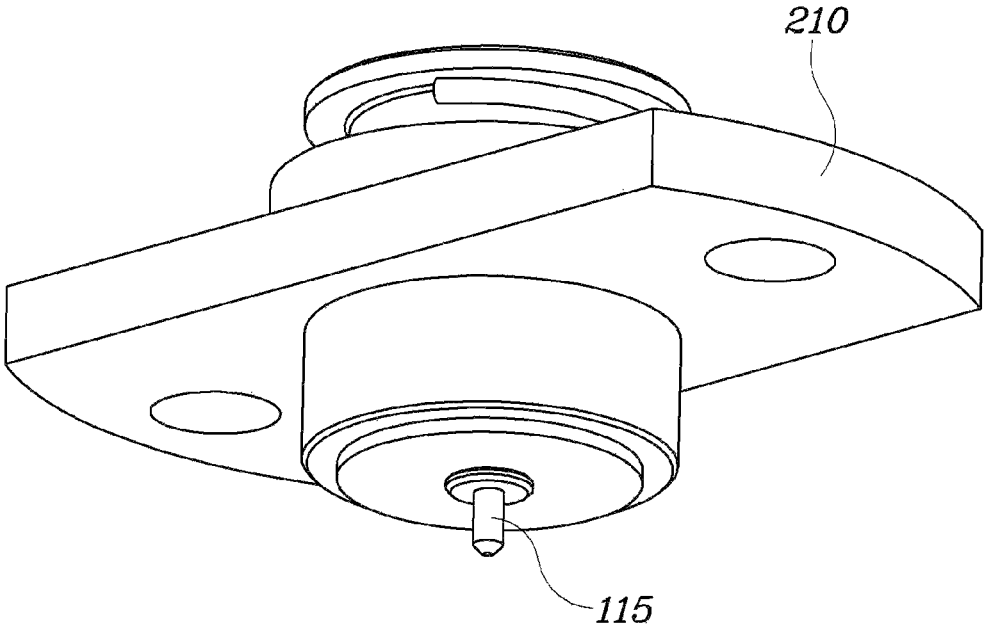

As shown in FIG. 15, the first ground portion 210 is formed in a panel shape in which grooves, to which screws are coupled, are formed in both sides thereof such that the first ground portion 210 is screw-coupled to the module.

As shown in FIG. 16, the first ground portion 210 is formed in a shape in which a plurality of ground pins GP inserted into a printed circuit board (PCB) soldering hole are formed such that the first ground portion 210 is soldered to a PCB.

First, PIMD characteristics are ameliorated.

In addition, a restoring force can be further increased.

Furthermore, a change in impedance is minimized.

In addition, it is possible to lower a height of a module including a board mating connector, easily couple the board mating connector, and stably fix the board mating connector.

DESCRIPTION OF REFERENCE NUMERALS

| | |
|---|---|
| 100: signal contact unit | 110: housing |
| 111: housing insertion hole | 112: housing protrusion |
| 113: housing slit | 114: housing groove |
| 115: contact pin | 120: contact portion |
| 121: contact portion insertion hole | 122: contact portion protrusion |
| 123: contact portion slit | 124: contact portion groove |
| 130: signal spring | 200: ground contact unit |
| 201: ground hollow portion | 210: first ground portion |
| 211: first ground hollow portion | 212: tapered portion |
| 213: latch portion | 214: thread |
| 215: tightening portion | 220: second ground portion |
| 221: second ground hollow portion | 222: second ground protrusion |
| 223: second ground slit | 230: ground spring |
| 300: dielectric unit | 310: first dielectric portion |
| 320: second dielectric portion | 321: second dielectric hollow portion |

We claim:

1. A board mating connector which includes a signal contact unit with ameliorated passive inter-modulation distortion (PIMD) characteristics, the board mating connector comprising:

a signal contact unit;

a ground contact unit which has a ground hollow portion, wherein the signal contact unit is inserted into the ground hollow portion; and a dielectric unit which is disposed between the signal contact unit and the ground contact unit, wherein the signal contact unit includes:

a housing which has a housing insertion hole of which one side is open;

a contact portion which has a contact portion insertion hole of which the other side is open, wherein:

the contact portion includes a contact portion protrusion which protrudes from an inner wall of the other end of the contact portion, and two or more contact portion slits which are elongated to one side of the contact portion from the other end thereof along a circumference of the contact portion; and a signal spring which is inserted between the one side of the housing insertion hole and the other side of the contact portion insertion hole, wherein one side of the housing is partially inserted into the contact portion insertion hole, and in a state in which the signal spring is compressed, an inner side of the contact portion comes into contact with an outer side of the housing so that the housing and the contact portion are electrically connected.

2. The board mating connector of claim 1, wherein, in a state in which the signal spring is restored, the contact portion protrusion is inserted into a housing groove formed in a ring shape along a circumference of the housing.

3. The board mating connector of claim 1, wherein the ground contact unit includes:

a first ground portion which has a first ground hollow portion; and a second ground portion of which the other side is partially inserted into the first ground hollow portion and which has a second ground hollow portion.

4. The board mating connector of claim 3, further comprising a ground spring which is disposed between an inner side of the first ground portion and an outer side of the second ground portion, wherein, when the second ground portion is moved in a direction of the first ground portion, the ground spring is compressed by the second ground portion, and the compressed ground spring is restored so that the second ground portion is moved in a direction opposite to the direction of the first ground portion.

5. The board mating connector of claim 4, wherein:

the first ground portion includes a tapered portion which is formed on an inner wall of the first ground portion so as to have an inclined shape such that an inner diameter thereof is gradually decreased toward the other side thereof; and the second ground portion includes a second ground protrusion which protrudes outward from the other end of the second ground portion and two or more second ground slits which are elongated to one side of the second ground portion from the other end thereof along a circumference of the second ground portion, wherein, when the second ground portion is moved in the direction of the first ground portion, an outer diameter of the second ground protrusion is compressed by the tapered portion, and the compressed outer diameter of the second ground protrusion is restored in a direction in which an inner diameter of the tapered portion is increased so that the second ground portion is moved in the direction opposite to the direction of the first ground portion.

6. The board mating connector of claim 3, wherein:

the first ground portion includes a tapered portion of which an inner diameter is gradually decreased toward the other side thereof on an inner wall of the first ground portion; and the second ground portion includes a second ground protrusion which protrudes outward from the other end of the second ground portion and two or more second ground slits which are elongated to one side of the second ground portion from the other end thereof along a circumference of the second ground portion, wherein, when the second ground portion is moved in a direction of the first ground portion, an outer diameter of the second ground protrusion is compressed by the tapered portion, and the compressed outer diameter of the second ground protrusion is restored in a direction in which an inner diameter of the tapered portion is increased so that the second ground portion is moved in a direction opposite to the direction of the first ground portion.

7. The board mating connector of claim 3, wherein:

the dielectric unit includes a first dielectric portion which is disposed between the first ground portion and the signal contact unit; and a second dielectric portion which is disposed between the second ground portion and the signal contact unit, wherein a second dielectric hollow portion having a diameter greater than that of the signal contact unit is formed in the second dielectric portion so that the second dielectric portion is in surface contact with the second ground portion and is not in surface contact with the signal contact unit.

8. The board mating connector of claim 3, wherein:

the first ground portion includes a thread formed on a circumference of the other side of the first ground portion; and a tightening portion formed to have three or more surfaces on a circumference of one side of the first ground portion.

9. A board mating connector which includes a signal contact unit with ameliorated passive inter-modulation distortion (PIMD) characteristics, the board mating connector comprising:

a signal contact unit;

a ground contact unit which has a ground hollow portion, wherein the signal contact unit is inserted into the ground hollow portion; and a dielectric unit which is disposed between the signal contact unit and the ground contact unit, wherein the signal contact unit includes:

a housing which has a housing insertion hole of which one side is open, wherein:

the housing includes a housing protrusion which protrudes from an inner wall of one end of the housing, and two or more housing slits which are elongated from one end of the housing to the other side thereof along a circumference of the housing;

a contact portion of which the other side is partially inserted into the housing insertion hole; and a signal spring which is inserted between the one side of the housing insertion hole and the other side of the contact portion, wherein, in a state in which the signal spring is compressed, an outer side of the contact portion comes into contact with an inner side of the housing so that the housing and the contact portion are electrically connected.

10. The board mating connector of claim 9, wherein, in a state in which the signal spring is restored, the housing protrusion is inserted into a contact portion groove formed in a ring shape along a circumference of the contact portion.

11. The board mating connector of claim 9, wherein the ground contact unit includes:

a first ground portion which has a first ground hollow portion; and a second ground portion of which the other side is partially inserted into the first ground hollow portion and which has a second ground hollow portion.

12. The board mating connector of claim 11, further comprising a ground spring which is disposed between an inner side of the first ground portion and an outer side of the second ground portion, wherein, when the second ground portion is moved in a direction of the first ground portion, the ground spring is compressed by the second ground portion, and the compressed ground spring is restored so that the second ground portion is moved in a direction opposite to the direction of the first ground portion.

13. The board mating connector of claim 12, wherein:

the first ground portion includes a tapered portion which is formed on an inner wall of the first ground portion so as to have an inclined shape such that an inner diameter thereof is gradually decreased toward the other side thereof; and the second ground portion includes a second ground protrusion which protrudes outward from the other end of the second ground portion and two or more second ground slits which are elongated to one side of the second ground portion from the other end thereof along a circumference of the second ground portion, wherein, when the second ground portion is moved in the direction of the first ground portion, an outer diameter of the second ground protrusion is compressed by the tapered portion, and the compressed outer diameter of the second ground protrusion is restored in a direction in which an inner diameter of the tapered portion is increased so that the second ground portion is moved in the direction opposite to the direction of the first ground portion.

14. The board mating connector of claim 11, wherein:

the first ground portion includes a tapered portion of which an inner diameter is gradually decreased toward the other side thereof on an inner wall of the first ground portion; and the second ground portion includes a second ground protrusion which protrudes outward from the other end of the second ground portion and two or more second ground slits which are elongated to one side of the second ground portion from the other end thereof along a circumference of the second ground portion, wherein, when the second ground portion is moved in a direction of the first ground portion, an outer diameter of the second ground protrusion is compressed by the tapered portion, and the compressed outer diameter of the second ground protrusion is restored in a direction in which an inner diameter of the tapered portion is increased so that the second ground portion is moved in a direction opposite to the direction of the first ground portion.

15. The board mating connector of claim 11, wherein:

the dielectric unit includes a first dielectric portion which is disposed between the first ground portion and the signal contact unit; and a second dielectric portion which is disposed between the second ground portion and the signal contact unit, wherein a second dielectric hollow portion having a diameter greater than that of the signal contact unit is formed in the second dielectric portion so that the second dielectric portion is in surface contact with the second ground portion and is not in surface contact with the signal contact unit.

16. The board mating connector of claim 11, wherein:

the first ground portion includes a thread formed on a circumference of the other side of the first ground portion; and a tightening portion formed to have three or more surfaces on a circumference of one side of the first ground portion.

* * * * *